United States Patent [19]

Heiser

[11] 4,136,600

[45] Jan. 30, 1979

[54] ARRANGEMENT FOR CONTROLLING THE SPEED OF A HYDRAULIC MOTOR

[75] Inventor: Joachim Heiser, Stuttgart, Fed. Rep. of Germany

[73] Assignee: Robert Bosch GmbH, Stuttgart, Fed. Rep. of Germany

[21] Appl. No.: 775,363

[22] Filed: Mar. 4, 1977

[30] Foreign Application Priority Data

Mar. 6, 1976 [DE] Fed. Rep. of Germany ..... 2609434

[51] Int. Cl.[2] ..... F15B 9/03; F15B 9/09; F15B 15/22

[52] U.S. Cl. ..... 91/27; 91/31; 91/363 R; 91/445; 91/447

[58] Field of Search ..... 91/365, 405, 31, 367, 91/27, 445

[56] References Cited

U.S. PATENT DOCUMENTS

| | | | |
|---|---|---|---|
| 2,855,752 | 10/1958 | Brusque | 91/31 |
| 3,015,313 | 1/1962 | Faisandier | 91/365 |
| 3,216,444 | 11/1965 | Herner | 91/405 |
| 3,272,083 | 9/1966 | Stoll | 91/405 |
| 3,875,849 | 4/1975 | Patel | 91/367 |

*Primary Examiner*—Paul E. Maslousky
*Attorney, Agent, or Firm*—Michael J. Striker

[57] ABSTRACT

An arrangement for controlling a hydraulic motor having a movable member with opposite faces to be impinged by pressure fluid, in which first valve means serve to direct pressure fluid against a respective one of the opposite faces to thus control the direction of movement of the movable member, and in which second valve means connected in a hydraulic circuit with the first valve means serve to control the speed of the motor in connection with control means actuated by the movable member for controlling the change of the speed dependent on the position of this member.

6 Claims, 2 Drawing Figures

ARRANGEMENT FOR CONTROLLING THE SPEED OF A HYDRAULIC MOTOR

BACKGROUND OF THE INVENTION

The present invention relates to an arrangement for control of a hydraulic motor, the two opposite faces of which to be impinged by pressure fluid are operatively connected with a first valve means for controlling the direction of movement of the motor, in which second valve means are connected in a hydraulic circuit with the first valve means for controlling the speed of the motor and in which further control means are provided which are actuated from a movable member of the motor to influence the change of the speed of the motor dependent on the position of the movable member.

In a known arrangement of this type for control of the advancing movement of a member of a machine tool, a separate block is provided for controlling the speed in which for two advancing movements of a reciprocating drive two fluid stream controllers, a four-way solenoid operated valve, as well as a roller actuated delay valve are provided. The roller actuation is necessary in order to assure a smooth deceleration of large masses between exactly determined end positions. The roller actuation requires, however, to space the block for control of the speed a certain distance from the block for control of the direction of the movable member of the tool machine, in which the two blocks have to be connected by conduits with each other. Such an arrangement requires therefore a relatively large space. In addition the adaptation of the arrangement for different load conditions is cumbersome.

It is also known to use in a control arrangement of the aforementioned kind an electrohydraulic servo valve and external electronic signal receivers. The disadvantage of this known arrangement is, however, that its operating safety is far from perfect and also that it is very expensive to produce.

SUMMARY OF THE INVENTION

It is an object of the present invention to provide a control arrangement of the aforementioned kind which avoids the mentioned disadvantages of such control arrangements known in the art.

It is a further object of the present invention to provide for such control arrangements which can be produced at very reasonable cost, while providing at the same time an optimal operating safety.

With these and other objects in view, the control arrangement of the invention for controlling the direction of movement and speed of a hydraulic motor, having a movable member with a pair of opposite faces to be alternately impinged by pressure fluid, mainly comprises first valve means for controlling the direction of movement of the movable member, second valve means for controlling the speed of the movable member in dependence on the position thereof and comprising a throttle valve in one of the conduits feeding pressure fluid to a respective one of the opposite faces, in which the throttle valve includes a valve slide movable between a plurality of positions respectively controlling the amount of pressure fluid passing therethrough, a pressure reducing valve upstream of the throttle valve in the aforementioned conduit, and a proportional magnet connected to the valve slide for moving the same between the positions thereof. The control arrangement includes further a first inductively operating transducer connected with the proportional magnet into a feedback position control circuit, a first electrical control device coordinated with the feedback position control circuit, control means actuated by the aforementioned movable member and influencing change of the speed of the latter in dependence on the position thereof, which control means includes at least a second inductively operating position transducer for indicating the actual value of displacement of the movable member, and in which the control means forms part of a second feedback circuit.

In this way a control arrangement is derived which is relatively simple in its construction and which assures a high degree of safety, whereby the valves for controlling the direction of movement and speed of the movable member can be arranged closely to each other. In addition, the control arrangement will operate relatively fast and exact.

An especially high degree of operational safety is derived, which can be produced with relatively small additional cost, if a third inductively operating position transducer is provided which forms with the second position transducer a redundant control circuit and which is operatively connected with a second electrical control device, which in turn is operatively connected with the first electrical control device and a differential amplifier into the second feedback circuit.

The novel features which are considered as characteristic for the invention are set forth in particular in the appended calims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
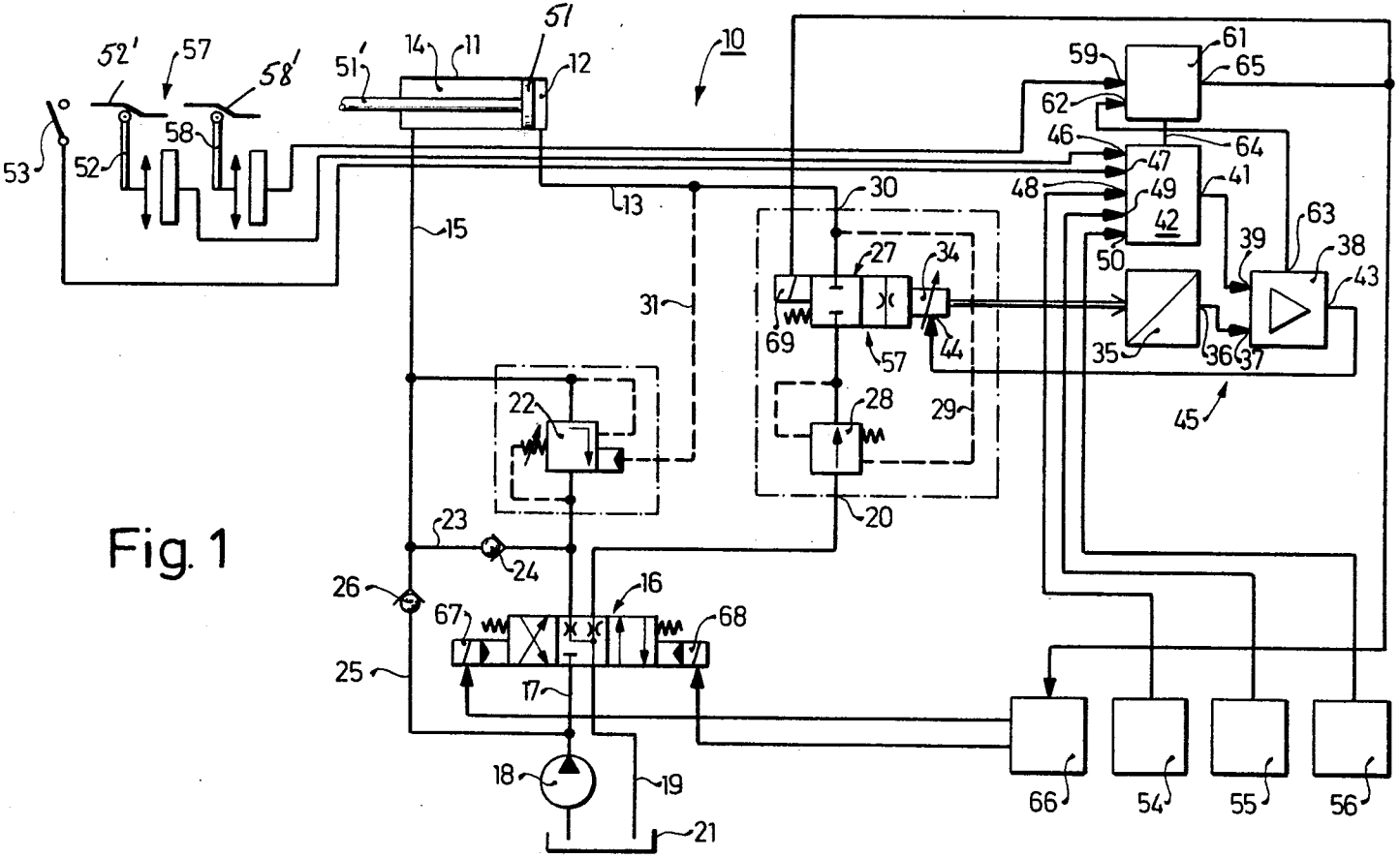
FIG. 1 is a schematic illustration of the control arrangement according to the invention for controlling a hydraulic motor.

FIG. 1 illustrates an arrangement which includes a hydraulic motor having a cylinder 11 in which a piston 51, to which a piston rod 51' is connected, is arranged for reciprocating movement in axial direction. The piston 51 divides the interior of the cylinder 11 into a cylinder compartment 12 to the right side of the piston 51 and a piston rod compartment 14 to the left side of the piston through which the piston rod 51' extends. A first working conduit 13 communicates with the cylinder compartment 12 and a second working conduit 15 communicates with the piston rod compartment 14. A first valve means 16 for controlling the direction of movement of the movable member of the motor, that is the piston 51 and the piston rod 51' connected thereto, is interconnected with the conduits 13 and 15, for controlling the direction of movement of the movable member. The valve means 16 is movable between three positions and is connected by a feed conduit 17 to a pump 18, providing the pressure fluid for the hydraulic motor, and by a return conduit 19 to a tank 21, containing the fluid for the pump 18. To assure maintainance of a predetermined pressure in the piston rod compartment 14, a pressure gradient valve 22 is arranged in the second working conduit 15, which reduces the fluid pressure imparted thereto at the inlet end by a predetermined amount. A first branch circuit 23 with a first check valve 24 is arranged in parallel to the pressure gradient valve 22. The check valve 24 is arranged to prevent outflow of fluid from the piston rod compartment 14 over the first branch conduit 23. A second branch conduit 25 is connected in parallel to the pressure gradient valve 22 and the first valve means 16, in which a second check valve 26 is arranged, preventing direct flow of pressure fluid from the pump 18 through the second branch conduit 25 into the second working conduit 15 to permit a rapid traverse motion of the movable member 51, 51'.

Figure 2:
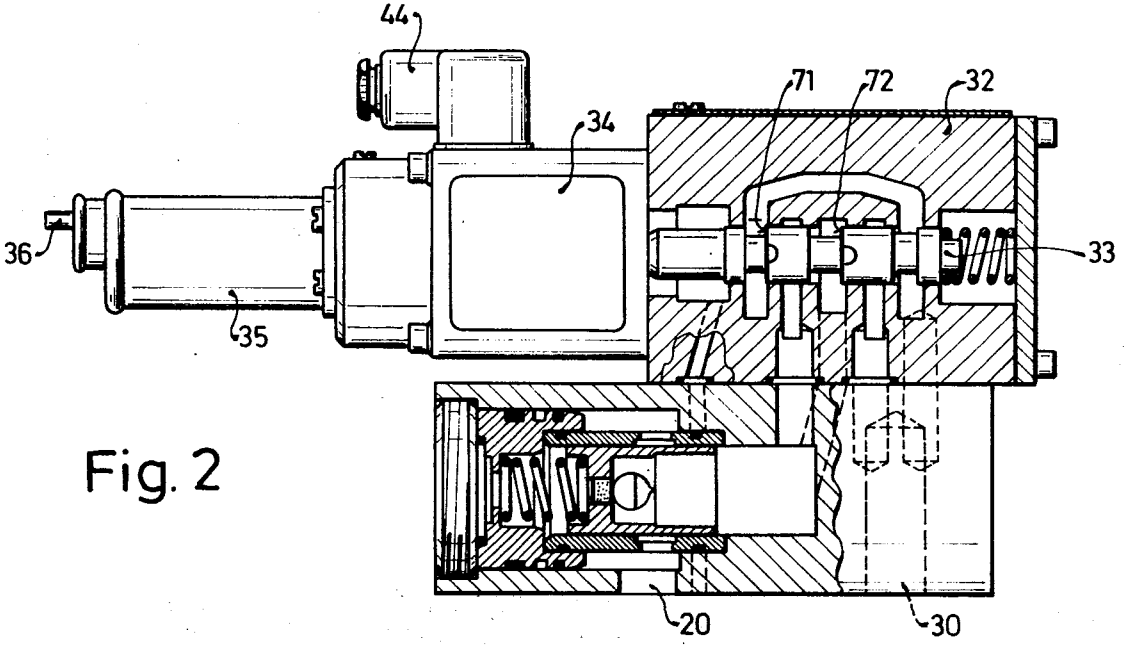
FIG. 2 is a partially sectioned side view of the throttle valve of the control arrangement with the pressure reducing valve, the proportional magnet and the first inductively operated position transducer directly connected thereto.

A throttle valve 27 and a pressure reducing valve 28 upstream of the throttle valve are located in the first working conduit 13. The pressure reducing valve 28 is additionally impinged over a control conduit 29 with the fluid pressure prevailing between the cylinder compartment 12 and the throttle valve 27 and cooperates with the latter as fluid stream regulator. A second control conduit 31 leads from the first working conduit 13 to the pressure gradient valve 22. The throttle valve 27 includes, as shown in FIG. 2, a housing 32 and a valve slide 33 reciprocable in axial direction in a bore of the housing and movable between a plurality of positions thereof by the armature of a proportional magnet 34. The proportional magnet 34 is to be understood as a magnet in which the armature thereof will take different positions depending on the magnitude of the voltage or the current applied to the magnet winding. A first inductively operating position transducer 35 is, as shown in FIG. 2, directly connected to one end of the proportional magnet 34, and the output 36 of the transducer 35 is connected to a first input 37 of a differential amplifier 38 for transmitting to the latter signals depending on the position of the armature of the proportional magnet 34. A second input 39 of the differential amplifier 38 receives signals from the output 41 of a first electrical control device 42, whereas the output 43 of the differential amplifier 38 is connected in circuit with the input 44 of the porportional magnet 34. The proportional magnet 34 is therewith connected into a feedback position circuit 45. The fluid connections for the unit comprising the throttle valve 27 and the pressure reducing valve 28 are designated in FIG. 2 with the reference numerals 20 and 30.

The first electrical control device 42 has five inputs 46, 47, 48, 49, and 50, and the first input 46 is connected with a second inductively operating position transducer 52, which serves during outward movement of the piston rod 51' as an actual valve transducer for regulation of the change of the speed of the piston rod 51'. The second input 47 is connected with a limit switch 53, the third input 46 and the fourth input 49 are respectively connected with desired value setting means 54 and 55 for two different advancing speeds of the piston rod 51', and the fifth input 50 is connected with retardation course setting means 56. The throttle valve 27 is therefore located in a second feedback circuit to which the actual position values are applied from the second position transducer 52 and the desired values from the setting means 54, 55 and 56.

In order to obtain a redundant control circuit, a third inductively operating position transducer 58 operable from the piston rod 51' is provided in addition to the second transducer 52 and the output of the third position transducer 58 is connected in circuit with the input 59 of a second electrical control device 61, the second input 62 of which is connected in circuit with the control output 63 of the differential amplifier 38. In addition, an operative connection 64 is provided between the electrical devices 42 and 61. The output 65 of the second electrical control device 61 is connected with the setting means 66, which controls the magnets 67 and 68 of the valve 16 for moving the latter between the positions thereof. The output 65 is further connected with an additional magnet 69 provided on the throttle valve 27. As schematically shown in FIG. 1, the second and third inductively operating position transducer means include each a cam 52', respectively 58', which are operatively connected in a manner not shown in FIG. 1, to the piston rod 51' for movement therewith in longitudinal direction and respectively cooperating with roller follower means to displace the latter in the direction as indicated by the double-headed arrows, to thereby produce inductively, in a manner known per se, signals depending on the position of the follower means which signals, as mentioned before, are respectively transmitted to the first and second electrical control devices 42 and 61.

The throttle valve 27 comprises, as shown in further detail in FIG. 2, a housing 32 formed with a longitudinal bore therethrough which is intersected by a plurality of fluid passages. The valve slide 33 is axially movable in the longitudinal bore of the throttle valve 27, and the valve slide 33 has a first and a second control edge 71, respectively 72 which overlap the fluid passages formed in the housing 32 to different degrees. The throttle valve 27 is thereby connected to the pressure reducing valve 28 in such a manner that it can be flown through with pressure fluid in parallel at both control edges 71 and 72. As shown in FIG. 2, the fluid enters the housing 73 of the pressure reducing valve 28 through the inlet 20 passes then through a plurality of bores 75 and an annular groove communicating therewith in the bushing 74 fixedly arranged in a bore of the housing 73 through an opening 77 in the peripheral wall of the cup-shaped valve member 76 into the interior of the latter and from there into the axial bore of the housing 73 to the right side of the valve member 76. From there the fluid passes through bore 78 in the housing 73 and an aligned bore portion in the housing 32 of the throttle valve 27 into a passage 79 surrounding the land 85 of the valve slide or valve spool 33 of the throttle valve 27. At the same time, fluid from the axial bore in the housing 73 of the pressure reducing valve 28 passes also through a passage 80, shown in dotted lines in FIG. 2, into the annular passage 81 formed in the housing 32 between the two lands 85 and 86 of the valve spool 33. In the position of the valve spool 33 as shown in FIG. 2 which corresponds to the position shown in FIG. 1, pressure fluid does not flow from the inlet 20 to the outlet 30 of the pressure reducing valve 28.

However, if the valve slide 33 is moved by the proportional magnet 34 to a first position in which the control edge 71 enters into the annular passage 79, then a restricted flow of fluid will pass from the annular passage 79 past the control edge 71 into the curved passage 83 formed in the housing 32 and from there through the bore portion 84 shown in dotted lines to the outlet 30.

It will be noted that the land 86 is longer than that of the land 85 and that in the above-described first position of the valve slide 33 the flow connection between the annular passage 81 and the outlet 30 is still interrupted.

However, if valve slide 33 is now moved by the proportional magnet 34 further to the right, as viewed in FIG. 2, to a second position so that the control edge 72 enters into the annular passage 87 a second flow path will be opened and additional fluid will flow from the annular passage 81 into the annular passage 87 and from there through the bore 88 into the outlet 30 of the pressure reducing valve 28 while the first described flow path remains open. The various cross sections are so dimensioned that the valve 27 controls with its first control edge 71 the fine regulating region for small fluid streams (for instance about 10 liters per minute), whereas for larger fluid streams fluid may also pass past the second control edge 72.

The proportional magnet 34 together with the first position transducer 35 are connected to one end face of the housing 32. The additional magnet 69, not shown in FIG. 2, is connected to the opposite end face of the housing 32.

The above described arrangement will operate as follows:

If the arrangement 10 is not actuated, the first working conduit 13 is interrupted by the throttle valve 27, when the latter is in the position as shown in FIG. 1, and the piston 51 with its piston rod 51' is thereby hydraulically blocked in the cylinder 11.

In order to move the piston rod 51' out of the cylinder 11, the valve slide of the valve 16 is moved by means of the direction setting means 66 and the magnet 67 towards the right, as viewed in FIG. 1, so that pressure fluid from the pump 18 flows over the first working conduti 13 into the cylinder compartment 12. At the same time, pressure fluid flows from the piston rod compartment 14 over the second working conduit 15, the second branch conduit 25 with the check valve 26, into the feed conduit 17 resulting in a rapid traverse speed control. The pressure gradient valve 22 is thereby not yet active since the prevailing pressure level is still too small. The setting means 54 for the rapid traverse speed is actuated simultaneously with the direction setting means 66, whereby the first electrical control device 42 acts over the differential amplifier 38 unto the proportional magnet 34. The valve slide 33 of the throttle valve opens thereby widely so that a large pressure fluid stream, necessary for the fast transverse speed, may flow in parallel past both control edges 71 and 72, from the pressure reducing valve 28 into the cylinder compartment 12. The thereby prevailing position of the armature of the proportional magnet 34 and therewith that of the control slide 33 is inductively determined by the first position transducer 35 and is transmitted by corresponding electrical signals to the differential amplifier 38. The displacement time for the armature of the position regulated proportional magnet is thus below the switching time of normal magnet valves. In order to obtain an exact speed regulation independent of the load, the pressure reducing valve 28 is connected in series with the throttle valve 27 and this valve combination acts therewith as electrically stepless adjustable fluid stream regulator with a highly progressive characteristic curve.

If the arrangement is used in a machine tool, the piston rod 51' moving out of the cylinder 11 moves a workpiece as fast as possible closely adjacent to a tool, whereafter the workpiece has to be decelerated within an exactly determined short stroke from the rapid traverse speed to a working speed. The outwardly moving piston rod 51' actutates thereby by means of the cams 52' and 58', after a fast traversed partial stroke, the second and third position transducers 52 and 58 simultaneously. The second position transducer 52 transmits thereby electrical signals proportional to its stroke to the first electrical control device 42 which, corresponding to the signal transmitted, controls, by means of the amplifier 38 and the position controlled proportional magnet 34, the position of the valve slide 33 in the throttle valve 27 and therewith the amount of pressure fluid passing therethrough, for instance by closing the flow path controlled by edge 72. The signals at the output 41 of the first electrical control device 42 are thereby also influenced by the preprogrammed value of the setting means 55 for the working speed, as well as from the preprogrammed retardation course of the setting means 56, in order to control the transition from the fast traverse speed to the working speed corresponding to the signals of the second transducer means 52. By means of the reterdation course setting means 56, the retardation course can thus be influenced in such a manner that, withouth displacement of the cam 52', different retardation courses and therewith an optimal retardation of even large masses connected to the piston rod 51' may be obtained.

The signals form the third position transducer 58, which is operated in synchronism with the second position transducer 52, are transmitted to the second electrical control device 61 and there compared with the desired value signals from the first electrical control device 42 and/or with a difference signal from the amplifier 38. If this comparison shows that the actual retardation at the piston rod 51' differs too much from the desired value of the retardation, then a fast disconnection is actuated. Thereby, the second control device 61 may, by means of the direction setting means 66, act on the valve 16 and return the control slide thereof to the middle position, as shown in FIG. 1. A retardation is thereby obtained which will depend on the actuating time of the magnet 67 and on the throttle cross section of the throttles provided in the valve 16. In addition thereto, the throttle valve 27 is quickly disconnected by the first electrical control device 61 over an additional magnet 69 and therewith the first working conduit 13 will be more or less throttled or interrupted. As long as the piston rod 51' moves out with a working speed from the cylinder 11, the amount of pressure fluid flowing through the cylinder compartment 12 is so small that it will be controlled by the first control edge 71 of the throttle valve 27. In this especially advantageous manner it is possible to control pressure fluid streams of largely varying size (for instance one to hundred) with the same valve.

If the piston rod 51', which moves with working speed out of the cylinder 11, finally actuates the limit switch 53, further advance of the piston rod is stopped by the first electrical control device 42. During the time the piston rod 51' moves with its working speed out of the cylinder 11, pressure fluid from the piston rod compartment 14 flows, in a manner known per se, over the pressure gradient valve 22 to the valve 16 and further to the tank 21.

In order to move the piston rod 51' into the cylinder 11, the magnet 68 is energized by means of the direction setting means 66, to thereby actuate the valve slide of the valve 16 in such a manner that the pump 18 is connected over the first branch conduit 23 and the second working conduit 15 with the piston rod compartment 14 and the cylinder compartment 12 over the first working conduit 13 and the valve 16 with the tank 21. Thereby the inward movement of the piston rod may be controlled either by the throttle valve 27 or only by the amount of pressure fluid pumped by the pump 18.

The arrangement 10 assures thereby, even by breakdown of one element, with maximum safety and small expenditure a quick disconnection of the drive especially to prevent abutment of a tool at high speed onto a workpiece. In addition, all hydraulic valves of the arrangement may be connected in advantageous manner into a single block. Advantageous is further that an exact electrically controlled deceleration function, as well as adjustment to any desired speed can be carried out with a throttle valve and corresponding setting means for preprogramming. Advantageous is also the avoidance of bouncing during the start of the arrangement since the pressure reducing valve is already in its working position during speed changes. The arangement is further immune against fauling since it requires no small hydraulic control streams. By actuating the valve 16 and the throttle valve 27 simultaneously it is also possible to obtain soft switching transitions.

It will be understood that each of the elements described above, or two or more together, may also find a useful application in other types of arrangements for control the speed of hydraulic motors differing from the types described above.

While the invention has been illustrated and described as embodied in an arrangement for controlling the speed and direction of a hydraulic motor, it is not intended to be limited to the details shown, since various modifications and structural changes may be made without departing in any way from the spirit of the present invention.

Thus, for instance, it is possible to use only one of the above described possible arrangements for the quick disconnection. The comparison between desired value and actual value in the second electric control device may also be carried out in different ways. Of course, it is also possible to adapt the disclosed arrangement for more than two working speeds. The division of the different fluid streams at different speeds by the two control edges of the throttle valve is also variable.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In combination with a hydraulic motor having a movable member with a pair of opposite faces to be alternatingly impinged by pressure fluid to move the movable member in one and the opposite direction, a control arrangement for controlling the hydraulic motor comprising a source of pressure fluid; a pair of conduit means for feeding pressure fluid from said source onto said opposite faces, or to discharge pressure fluid therefrom; first valve means interconnected with said conduit means for controlling the direction of movement of said movable member; second valve means interconnected with said conduit means for controlling the speed of the movable member in dependence on the position thereof and comprising a throttle valve in one of said conduit means and having a valve slide movable between a plurality of positions respectively controlling the amount of pressure fluid passing therethrough, a pressure reducing valve upstream of said throttle valve in said one conduit, and a proportional magnet connected to said valve slide for moving the same between the positions thereof; a first inductively operated position transducer connected with said proportional magnet into a feed-back position control circuit; a first electrical control device coordinated with said feedback position control circuit; control means actuated by said movable member for influencing the change of the speed of the latter in dependence on the position thereof, said control means including at least a second inductively operating position transducer for indicating the actual value of displacement of said movable member, said control means forming part of a second feedback circuit.

2. A control arrangement as defined in claim 1, and including a third inductively operating position transducer forming with said second position transducer a redundant control circuit, a second electrical control device operatively connected with said third position transducer; and a differential amplifier connected with said first electrical control device into said second feedback circuit and operatively connected to said second electrical control device.

3. A control arrangement as defined in claim 2, wherein said throttle valve is solenoid operated and includes an additional magnet for shifting said valve slide to a position causing quick stopping of said movable member, said second electrical control device having an output connected in circuit with said additional magnet.

4. A control arrangement as defined in claim 2, wherein said first valve means is a solenoid operated multi-position valve, and including direction setting means operatively connected to the solenoids of said multi-position valve, said second electrical control device having an output connected in circuit with said direction setting means.

5. A control arrangement as defined in claim 1, wherein said throttle valve includes a housing formed with a bore therethrough in which said valve slide is movable in axial direction of said bore, and in parallel connected fluid passages communicating with said bore, said valve slide having a pair of controlling edges respectively overlapping said fluid passages to a different degree.

6. A control arrangement as defined in claim 2, and including two setting means for initiating different speeds of said movable member and a further retardation course setting means for said movable member, and wherein said first electrical control device has three inputs respectively in circuit with said setting means and an output connected with one input of said amplifier, which in turn is connected with said feedback position control circuit.

* * * * *